US005641158A

United States Patent [19]

Gelb, Jr. et al.

[11] Patent Number: 5,641,158

[45] Date of Patent: Jun. 24, 1997

[54] APPARATUS AND METHOD FOR RECEIVING A SHEET FROM A FIRST DIRECTION AND FEEDING THE SHEET IN A SECOND DIRECTION

[75] Inventors: Joseph Gelb, Jr., Milford; Edward M. Ifkovits, Jr., New Fairfield; Richard F. Stengl, Wolcott, all of Conn.

[73] Assignee: Pitney Bowes Inc., Stamford, Conn.

[21] Appl. No.: 546,752

[22] Filed: Oct. 23, 1995

[51] Int. Cl.[6] ..... B65H 5/00

[52] U.S. Cl. ..... 271/225; 198/718; 271/245; 271/264; 271/265.01; 271/184

[58] Field of Search ..... 271/225, 248, 271/245, 265.01, 264, 184; 198/718, 464.2

[56] References Cited

U.S. PATENT DOCUMENTS

| | | | |
|---|---|---|---|
| 4,726,461 | 2/1988 | Pokrinchak | 198/412 |
| 4,909,374 | 3/1990 | Skrypalle | 198/371 |
| 4,928,807 | 5/1990 | Auerbach | 198/379 |
| 5,074,544 | 12/1991 | Kulpa et al. | 271/225 |
| 5,180,154 | 1/1993 | Malick | 271/2 |
| 5,180,159 | 1/1993 | Malick | 271/302 |
| 5,188,355 | 2/1993 | Lowell et al. | 271/225 |
| 5,205,551 | 4/1993 | Nagano et al. | 271/184 |
| 5,413,326 | 5/1995 | Wright | 271/225 |
| 5,449,165 | 9/1995 | Naramoto | 271/184 |
| 5,538,240 | 7/1996 | Auerbach et al. | 271/225 |
| 5,538,241 | 7/1996 | Auerbach et al. | 271/225 |

*Primary Examiner*—H. Grant Skaggs

*Attorney, Agent, or Firm*—Angelo N. Chaclas; Charles R. Malandra, Jr.; Melvin J. Scolnick

[57] ABSTRACT

Apparatus and method for receiving a sheet from a first direction and transporting the sheet in a second direction. The apparatus comprising: a device for feeding the sheet in the second direction; a deck having an imput end for receiving the sheet from the first direction and an output end and including a lower deck plate and an upper deck plate pivotally mounted and vertically spaced above the lower deck plate. The apparatus further comprising a controller and a device for pivoting the upper deck plate between a closed position and an open position. The controller for causing the pivoting device to rotate the upper deck plate to the open position to receive the sheet from the first direction, causing the pivoting device to rotate the upper deck plate to the closed position after receiving the sheet and thereafter causing the feed device to feed the sheet in the second direction through the deck output end.

18 Claims, 4 Drawing Sheets

APPARATUS AND METHOD FOR RECEIVING A SHEET FROM A FIRST DIRECTION AND FEEDING THE SHEET IN A SECOND DIRECTION

FIELD OF THE INVENTION

This invention relates generally to sheet processing machines. More particularly, this invention is directed to an apparatus and method for receiving a sheet from a first direction and feeding the sheet in a second direction.

BACKGROUND OF THE INVENTION

Inserter systems capable of generating over 10,000 mail pieces per hour are well known in the art. Generally, inserter systems are used by organizations such as banks, insurance companies and utility companies for producing a large volume of specific mailings where the contents of each mail item are directed to a particular addressee. Additionally, other organizations, such are direct mailers, use inserters for producing a large volume of generic mailings where the contents of each mail item are substantially identical for each addressee. Examples of such inserter systems are the 8 Series™ and 9 Series™ inserter systems available from Pitney Bowes, Inc., Stamford, Conn.

In many respects the typical inserter system resembles a manufacturing assembly line. Sheets and other raw materials (other sheets, enclosures, envelopes) enter the inserter system as inputs. Then, a plurality of different modules or workstations in the inserter system work cooperatively to process the sheets until a finished mail piece is produced. The exact configuration of each inserter system depends upon the needs of each particular customer or installation. Thus, the typical inserter system may include such modules as: various web handling modules (slitters, cutters and bursters) for separating the continuous forms of a web into singular or discrete sheets, a sheet feeder module for feeding individual cut sheets, an accumulator module for assembling the sheets into a collation, a folder module for folding the collation into a desired configuration (Z-fold, C-fold, half fold), a conveyor/staging module for transporting and queuing the collation, a plurality of enclosure feeder modules for assembling and adding a packet of enclosures to the collation, an insert station module for inserting the collation into an envelope, and a control system to synchronize the operation of the overall inserter system to assure that the collations are properly assembled.

Devices are known which turn collations or sheets within a plane. These devices are often utilized in inserter systems to change the orientation of the sheets (for example, landscape to portrait and vice versa) so as to facilitate further downstream processing. Another application for turning devices is in merging sheets from a first stream of sheets into a second stream of sheets. Examples of turning devices utilized in inserter systems are shown in U.S. Pat. Nos.: 4,909,374, 5,180,154, 5,180,159, 5,188,355 and 5,413,326; all of which are assigned to the assignee of the present invention. Such devices are commonly referred to as a right angle transport (RAT).

The RAT accepts a sheet from an upstream module and feeds the sheet to a downstream module. Typically, the RAT includes a first feed means for feeding the sheet in a first direction, a second feed means for feeding the sheet in a second direction and reorienting means. The reorienting means redirects the sheet from the first direction to the second direction by transferring the sheet from the first feed means to the second feed means. Although these prior art RATs generally work well, they are expensive to manufacture and take up a lot of space. Therefore, they are not well suited for all applications.

Accordingly, there is a need for an apparatus and method for receiving a sheet from a first direction and feeding the sheet in a second direction without using a feed means in the first direction so as to reduce cost and size. Additionally, the apparatus and method must be capable of handling single sheets, booklets, a plurality of folded sheets and other sheet configurations without operator adjustments so as to reduce operating costs and setup time.

SUMMARY OF THE INVENTION

The present invention provides an apparatus and method for receiving a sheet from a first direction and feeding the sheet in a second direction. Conventionally, this invention may be used to reorient a sheet from landscape to portrait or vice versa.

In accordance with the present invention, the apparatus comprises: means for feeding the sheet in the second direction; a deck having an input end for receiving the sheet from the first direction and an output end and including a lower deck plate and an upper deck plate pivotally mounted and vertically spaced above the lower deck plate. The apparatus further comprising control means and means for pivoting the upper deck plate between a closed position and an open position such that the control means causes: the pivoting means to rotate the upper deck plate to the open position to receive the sheet from the first direction; the pivoting means to rotate the upper deck plate to the closed position after receiving the sheet; and, thereafter, the feed means to feed the sheet in the second direction through the deck output end.

In accordance with the present invention, the method comprises the step(s) of: receiving the sheet from the first direction into the input end of the deck where the upper deck plate is in the open position; pivoting the upper deck plate from the open position to the closed position; and thereafter, feeding the sheet in the second direction.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention. As shown throughout the drawings, like reference numerals designate like or corresponding parts.

DETAILED DESCRIPTION OF THE PREFERRED EMBODIMENT

Figure 1:
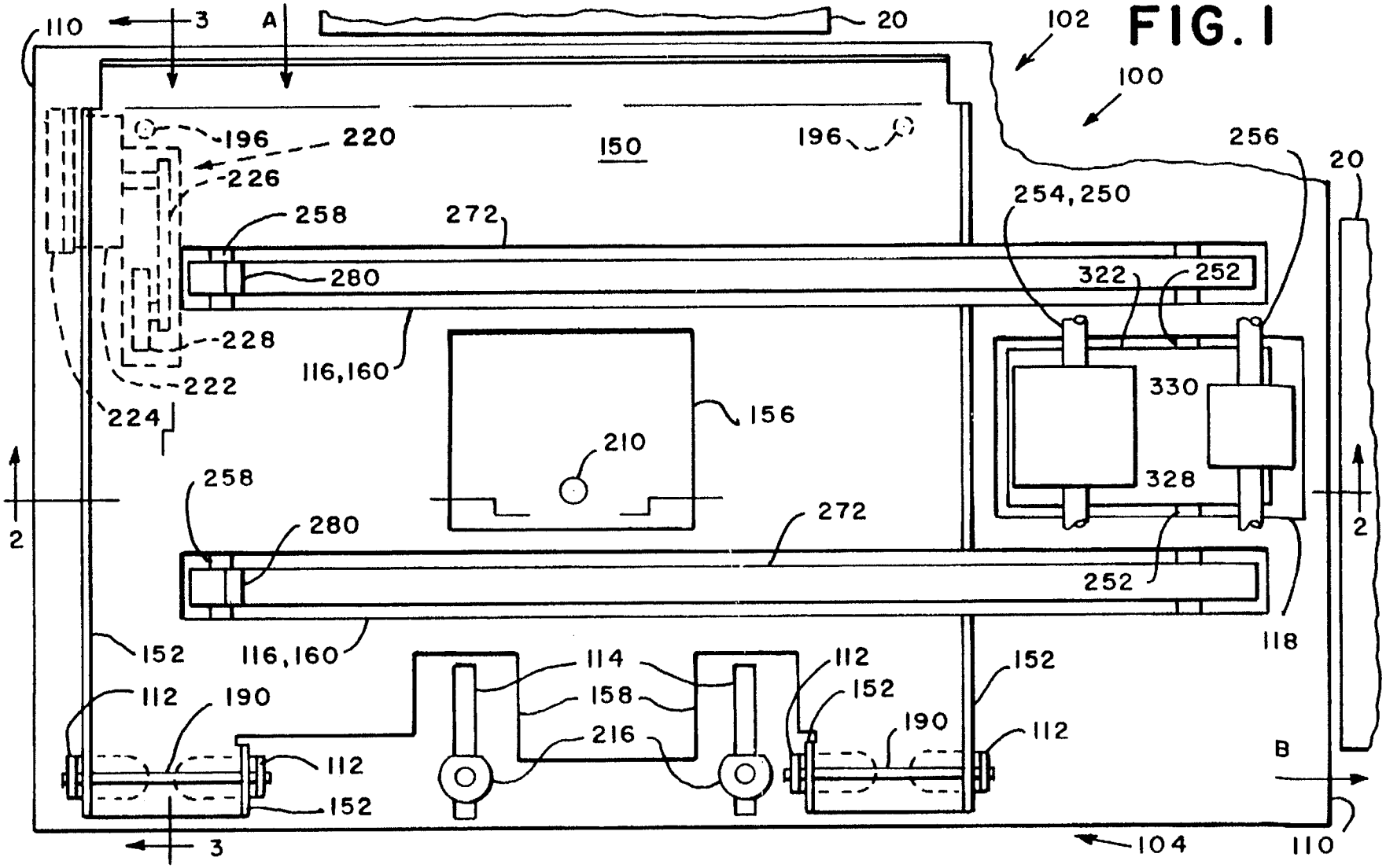
FIG. 1 is a plan view of an apparatus for receiving a sheet from a first direction and transporting the sheet in a second direction in accordance with the present invention.

Referring to FIG. 1, an apparatus 100 apparatus having an input end 102 for receiving a sheet 20 from a first direction, as indicated by arrow "A", and an output end 104 for transporting the sheet 20 in a second direction, as indicated by arrow "B", is shown. Generally, the sheet 20 is fed into the apparatus 100 from the first direction by an upstream module (not shown) and fed from the apparatus 100 in the second direction to a downstream module (not shown). As used herein, the term sheet refers: a single sheet, a plurality of sheets, a booklet, a folded plurality of sheets or other type of collation configuration.

Figure 2:
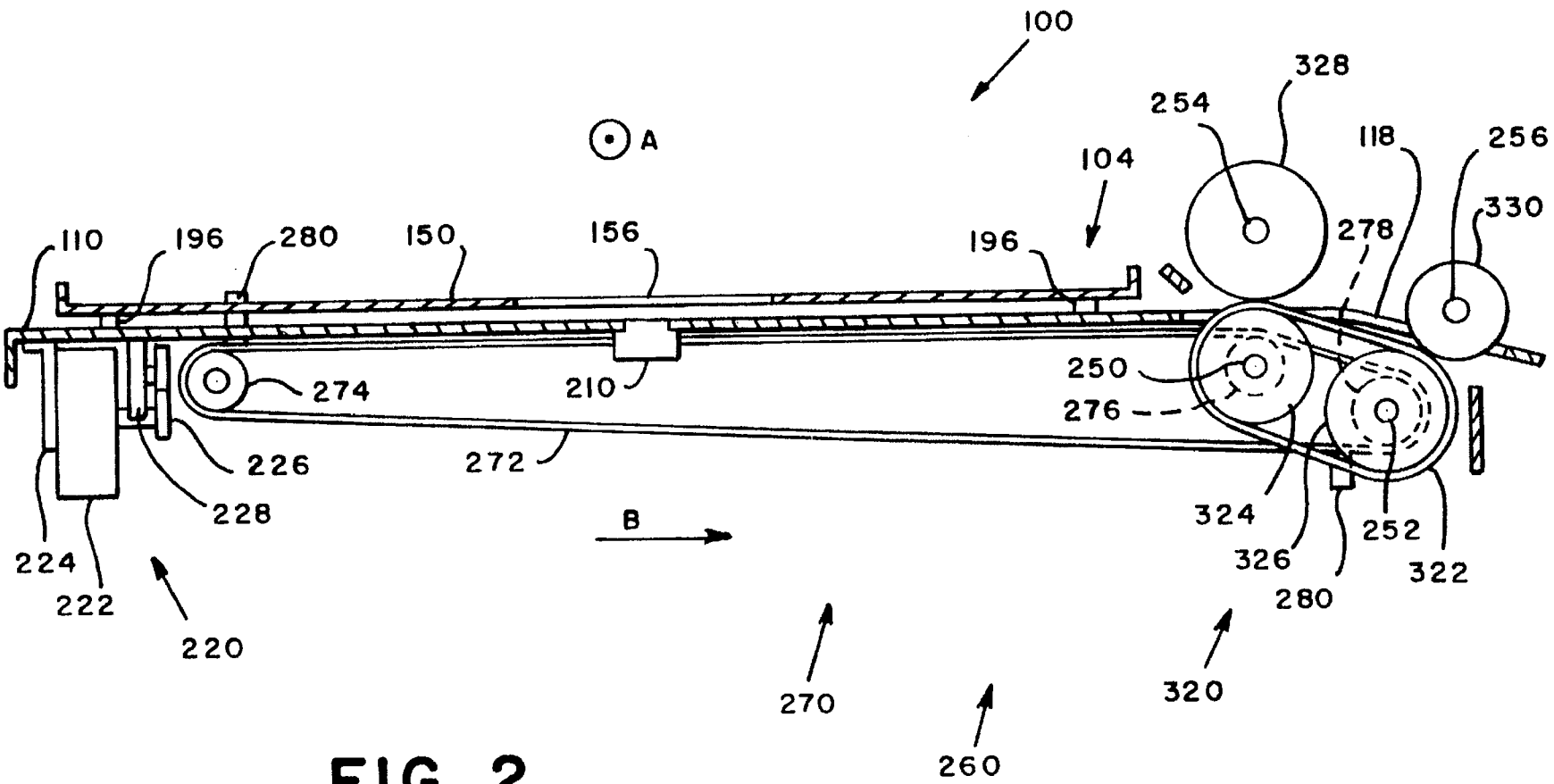
FIG. 2 is a sectional view taken along 2—2 as shown in FIG. 1.
Figure 3:
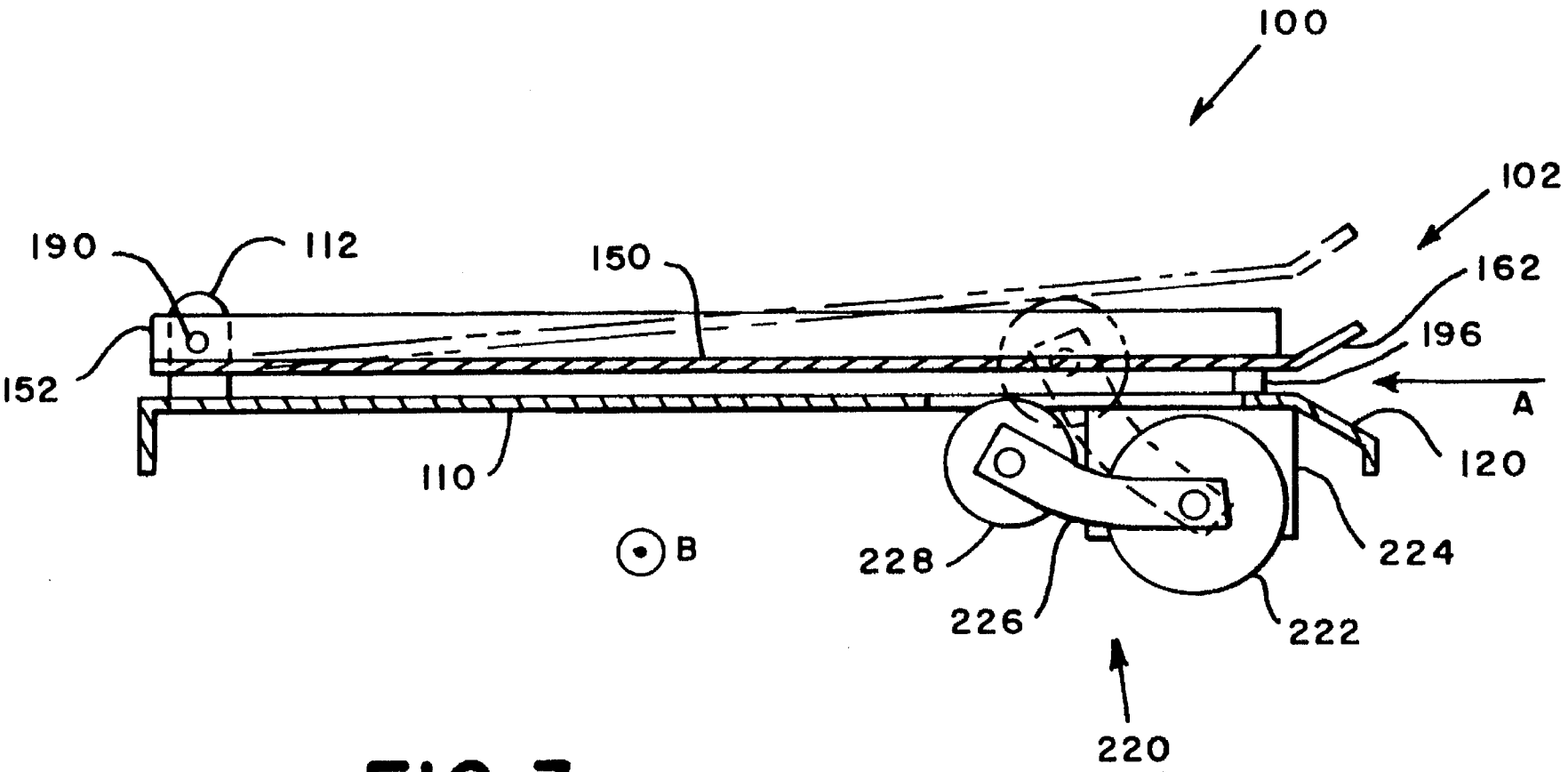
FIG. 3 is a sectional view taken along 3—3 as shown in FIG. 1.

Referring to FIGS. 1–3, the apparatus 100 includes a lower deck plate 110, an upper deck plate 150, a sensor 210, a pair of stops 216, a pivot assembly 220 and a transport assembly 260 aligned to feed successive sheets 20 in the second direction. The lower deck plate 110 is fixably mounted to any suitable framework by conventional device while the upper deck plate 150 is pivotally mounted to the lower deck plate 110. The space between the lower deck plate 110 and the upper deck plate 150 defines a paper path. In the preferred embodiment, the lower deck plate 110 and the upper deck plate 150 are made of sheet metal. However, other suitable materials may be substituted.

The lower plate 110 includes a plurality of tabs 112 while the upper deck plate 150 includes a plurality of flanges 152. The tabs 112 and flanges 152 are formed by bending up portions of the deck plates 110 and 150, respectively. Shafts 190 are pushed through holes in tabs 112 and flanges 152 to pivotally mount the upper deck plate 150 to the lower deck plate 110. The shafts 190 may be secured in place by any suitable device such as an E-clip (not shown). Additionally, bearings may be used in the holes to increase the stability of the upper deck plate 150 and to make for smoother rotation with less friction. Accordingly, the upper deck plate 150 is free to rotate about shafts 190 between an open position and a closed position. Gravity tends to keep the upper deck plate 150 in the closed position and spacers 196 located on the lower deck plate 110 maintain a proper gap between the lower deck plate 110 and the upper deck plate 150. Thus, in the closed position the deck plates are substantially parallel. It is important to note that spacers 196 are located outside of the paper path so as not to interfere with sheets 20 as they enter and exit from the apparatus 100.

The pivot assembly 220 selectively rotates the upper deck plate 150 from the closed position to the open position. It includes a rotary solenoid 222 fixably mounted to the underside of the lower deck plate 110 by an L-shaped bracket 224. One end of arm 226 is fixably mounted to the actuator of solenoid 222 so that when the solenoid 222 is energized the arm 226 rotates along with the actuator. Rotatively mounted to the other end of arm 226 is a roller 228. The solenoid 222, arm 226 and roller 228 are arranged so that when the solenoid 222 is de-energized and the upper deck plate 150 is in the closed position, the roller 228 is just barely touching the underside of the lower deck plate 110. When the solenoid 222 is energized the arm 226 rotates in a clock-wise direction as viewed in FIG. 3 and pivots the upper deck plate 150 to the open position as shown by dashed lines.

The sensor 210 is a conventional reflective type optical sensor and includes a light emitter and a light detector for measuring the amount of reflected light. The sensor 210 is mounted to the lower deck plate 110 and positioned to direct a beam of light into the paper path so as to detect the presence of the sheets 20. When a sheet 20 is present light is reflected back to the detector. On the other hand, when a sheet 20 is not present no light is reflected back to the detector. Thus, by monitoring the amount of light received by the detector, a determination can be made as to whether the sheet 20 is present or not. So that the upper deck plate 150 does not reflect light back to the detector when a sheet 20 is not present and thus cause the detector to give a false reading, the upper deck plate 150 includes a cut out 156 which lets the light pass out from the apparatus 100. Therefore, the detector receives more light when a sheet 20 is present than when a sheet 20 is not present.

The stops 216 halt travel of the sheets 20 in the first direction and are slideably mounted to slots 114 in the lower deck plate 110. Therefore, the stops 216 are adjustable to accommodate different size sheets 20. So that an operator has access to the stops 216 in order to reposition them along slots 114, the upper deck plate 150 contains cut outs 158. The stops 216 may be of any suitable design such as a typical spring loaded screw and nut assembly.

After the stops 216 have halted travel of the sheets 20 in the first direction, the transport assembly 260 feeds the sheets 20 in the second direction. The transport assembly 260 includes a pusher finger transport assembly 270 and a take-away transport assembly 320. The pusher finger transport assembly 270 includes a pair of endless belts 272 extending around respective sets of pulleys 274, 276 and 278. The belts 272 run beneath the lower deck plate 110 and include pusher fingers 280 which rise above and fall below the lower deck plate 110 as the belts 272 rotate. So as not to interfere with the pusher fingers 280, the lower deck plate 110 contains cut outs 116 while the upper deck plate 150 contains cut outs 160. As viewed in FIG. 2, the belts 272 rotate in a clock-wise direction.

The take-away transport assembly 320 includes endless belt 322 extending around pulleys 324 and 326 and normal force rollers 328 and 330. The endless belt 322 extends above the lower deck plate 110 through cut out 118. Pulleys 276 and 324 share a common shaft 250 while pulleys 278 and 326 share a common shaft 252. The remaining pulleys and rollers are supported on shafts 254, 256 and 258 accordingly. Shafts 250, 252, 254, 256 and 258 are rotatively mounted to any suitable structure (not shown) in a conventional manner. Shaft 252 is operatively coupled to a drive system (not shown) for causing the shaft 252 to rotate and thus supplying the necessary input drive for pusher finger transport assembly 270 and take-away transport assembly 320. Because the pulley 326 has a larger diameter than pulleys 278, the transport speed of take-away assembly 320 is greater than that of pusher finger assembly 270.

Figure 4:
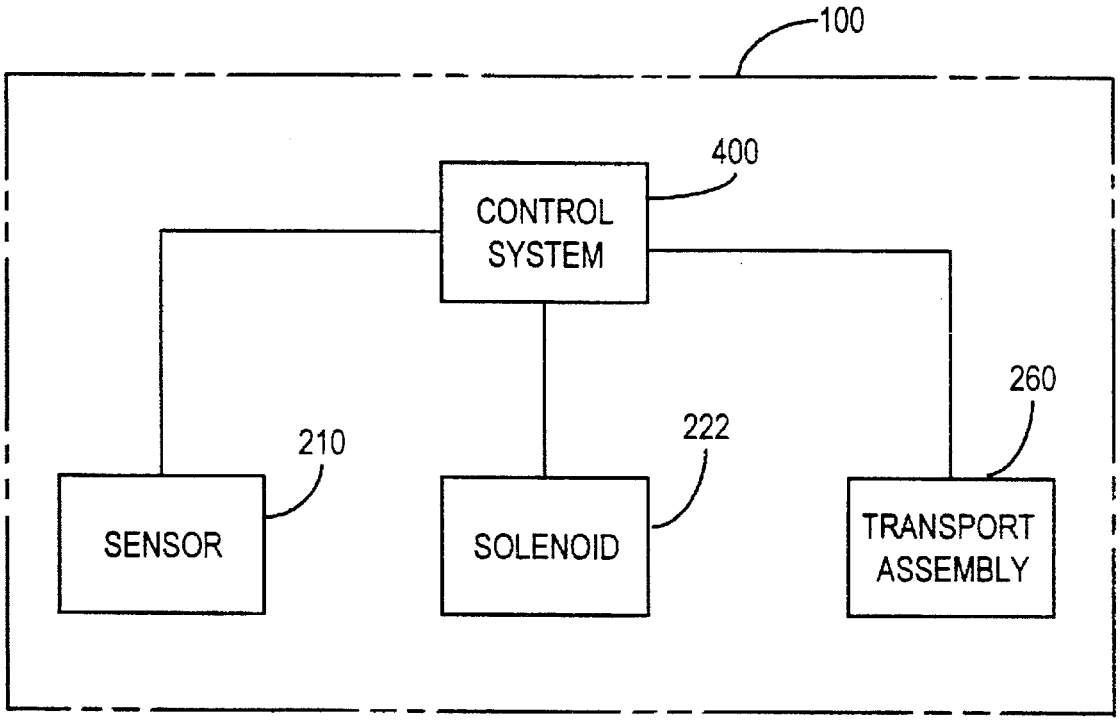
FIG. 4 is a block diagram the apparatus in accordance with the present invention.

Referring to FIG. 4, a control system 400 in communication with the sensor 210, the solenoid 222 and the transport assembly the transport assembly 260 is shown. The control system 400 may be of any suitable combination of hardware and software so as to accomplish its function of controlling the operation of apparatus 100. The sensor 210 provides an indication to the control system 400 concerning the presence or absence of sheets 20. Based upon the status of the sensor 210, the control system 400 selectively energizes the solenoid 222. Additionally, the control system 400 controls the operation of the transport assembly 260.

With the major structural aspects of the present invention described above, the operational characteristics of the present invention will now be described with respect to FIGS. 1–4. To receive a sheet 20 from the upstream module (not shown) traveling in the first direction as indicated by arrow "A" the control system 400 energizes the solenoid 222 so as to pivot the upper deck plate 150 to the open position. In the open position, the input end of the upper deck plate 150 is spaced apart further from the corresponding input end of the lower deck plate 110 than when the upper deck plate 150 is in the closed position. Therefore, the sheet 20 may more easily enter the paper path without jamming. Also to assist the sheet in entering the apparatus 100, the lower deck plate 110 and the upper deck plate 150 include appropriate lead-in flanges 120 and 162, respectively, at their input ends. Additionally, a further benefit is achieved if the lower deck plate 110 is positioned slightly below the output elevation of the upstream module.

Since the upper deck plate 150 is in the open position and nothing is in the paper path to obstruct the sheet 20, momentum causes the sheet 20 to continue to travel in the first direction. The cut outs 116, 160 and 156 all include appropriate flanges (not shown) so as to reduce the risk of a jam as the sheet 20 travels along the paper path between the lower deck plate 110 and the upper deck plate 150 in the first direction. Once the sensor 210 detects the lead edge of the sheet 20, the control system 400 de-energizes the solenoid 222 to return the upper deck plate 150 to the closed position. By this time, the sheet 20 has traveled well within the apparatus 100. The sheet 20 continues in the first direction until it hits up against stops 216 which prevent any further travel in the first direction. By the time the sheet 20 hits the stops 216 its speed has been greatly reduced due to friction. Therefore, bounce back is likely to be minimal. However, a brush (not shown) or other device may be added to prevent excessive bounce back.

Once the sensor 210 detects the lead edge of the sheet 20, the control system 400 waits a predetermined amount of time before advancing the pusher fingers 280. This ensures that the sheet 20 has reached to stops 216 and is ready to be transported in the second direction. The control system the advance of the pusher fingers 280 in a any conventional manner so that the pusher fingers operate in proper timed sequence with the arrival of the sheet 20. It is important that the pusher fingers 280 not be in the paper path as the sheet is traveling in the first direction. As the pusher fingers 280 rise above the lower deck plate 110, they contact the sheet 20 and feed the sheet 20 in the second direction toward the take-away assembly 320. As the lead edge of sheet 20 enters the nip between roller 328 and belt 322 the sheet 20 continues to feed in the second direction but at increased speed. Therefore, the take-away assembly 320 assumed control of the sheet 20 and advances the sheet ahead of the pusher fingers 280 before the pusher fingers fall below the lower deck plate 110. The take-away assembly 320 continues to feed the sheet 20 out of the apparatus 100 and toward the downstream module (not shown).

Finally, at some point in time before a subsequent sheet 20 arrives, the control system 400 energizes the solenoid 222 causing the upper deck plate 150 to pivot to the open position. Exactly when this occurs is merely a matter of design choice. However, the upper deck plate 150 should remain in the closed position at least until the sheet 20 has entered the nip of the take-away assembly 320 so as to maintain proper control over the sheet 20.

It should now be apparent that apparatus 100 achieves a right angle transport without having a feed means in the first direction. Therefore, apparatus 100 takes advantage of the momentum supplied to the sheet 20 from the upstream module. This reduces the cost of the present invention over other systems.

It should also be apparent that the pivoting upper deck plate 150 provide the advantage of being able to handle single sheets, booklets (large numbers of sheets) and other configuration without the need for operator adjustment. When the sheet 20 is made up of a single sheet, then it travels easily between the deck plates to reach the stops 216. However, when the sheet 20 is made up of a large number of sheets this would not ordinarily occur because of friction. In this case, friction is reduced on the sheets 20 by having the upper deck plate 150 in the open position because the sheets 20 will not be rubbing against the upper deck plate 150 until it is returned to the closed position. This ensures that the sheets 20 will have enough momentum to reach the stops 216. Otherwise, if the upper deck plate 150 where fixed in the closed position, then a large number of sheets or a heavy collection of sheets might not reach the stops 216 and a mis-alignment or jam would likely occur.

Another advantage is that the pivoting upper deck plate 150 clamps down on folded sheets 20 without creating unwanted drag or friction on the folded sheets 20. Those skilled in the art will appreciate that folded sheets 20 need to be controlled so that they do not spring back (expand) and begin to unfold. Expanded folded sheets often cause jams and are difficult to keep properly aligned. Therefore, the upper deck plate 150 in the closed position keeps folded sheets from springing back too far without applying excessive drag to the sheets.

Those skilled in the art will now appreciate that the present invention allows a large number of sheets or a plurality of folded sheets to enter the apparatus from a first direction without inducing too much drag on the sheets by having a pivoting upper deck plate 150. Then, once the sheets have substantially completed their travel in the first direction, the upper deck plate 150 is returned to the closed position so that the sheets 20 are properly controlled and ready for feeding in the second direction.

Many features of the preferred embodiment represent design choices selected to best exploit the inventive concept as implemented for producing a ninety degree change of direction. However, with minor modifications the present invention may be adapted to achieve changes of direction of different angles. Additionally, the structural components of the present invention have many known substitutes. For example, the upper deck plate 150 may be pivotally mounted to some structural member other than the lower deck plate 110. As another example, the sensor 210 may be exchanged for a mechanical switch. However, this is not preferred because of the drag created on the sheet 20.

Most significantly, many substitutes for the pivot assembly 220 would be readily apparent to those skilled in the art. For example, the rotary solenoid may be replaced with a linear (push-pull) solenoid without only minor changes. In this embodiment, the arm would function as a see-saw with a centrally located fixed pivot and the roller rotatively mounted to one end of the arm and the other end of the arm pivotally mounted to the linear solenoid. An other example is a cam mechanism. In this embodiment, the again behaves as a see-saw with a centrally located fixed pivot and the roller rotatively mounted to one end of the arm. However, the other end of the arm would have a follower roller rotatively mounted to it and be spring biased so that the follower roller remains in contact with a cam. Those skilled in the art will easily derive still other substitutions.

Since many modifications to the present invention will readily occur to those skilled in the art, the invention in its broader aspects is not limited to the specific details of the preferred embodiment. Accordingly, various modifications may be made without departing from the spirit of the general inventive concept as defined by the appended claims and their equivalents.

What is claimed is:

1. An apparatus for receiving a sheet from a first direction and transporting the sheet in a second direction, the apparatus comprising:

means for feeding the sheet in the second direction;

a deck having an input end for receiving the sheet from the first direction and an output end, the deck including a lower deck plate and an upper deck plate vertically spaced above the lower deck plate, the upper deck plate pivotally mounted to rotate between a closed position where the lower deck plate and the upper deck plate are substantially parallel and an open position where the distance between input ends of the lower deck plate and the upper deck plate is greater than that of the closed position;

means for pivoting the upper deck plate between the closed position and the open position; and control means in operative communication with the pivoting means for: causing the pivoting means to pivot the upper deck plate to the open position to receive the sheet from the first direction, causing the pivoting means to pivot the upper deck plate to the closed position after receiving the sheet and, thereafter, causing the feed means to feed the sheet in the second direction through the deck output end.

2. The apparatus of claim 1 wherein the sheet travels along a paper path from the input end to the output end of the deck, and further comprising sensor means in operative communication with the control means located along the paper path for detecting the presence of the sheet and wherein the control means causes the pivoting means to rotate the upper deck plate from the open position to the closed position after the sensor means detects the sheet.

3. The apparatus of claim 2 wherein the control means causes the feed means to feed the sheet in the second direction through the deck output end after the sensor means detects the sheet.

4. The apparatus of claim 3 further comprising stop means located along the paper path for halting travel of the sheet in the first direction and wherein the feed means feeds the sheet in the second direction after the sheet has halted travel in the first direction.

5. The apparatus of claim 4 wherein the pivoting means comprises:

a rotary solenoid fixably mounted to the lower deck plate;

an arm having a first end and a second end fixably mounted to the rotary solenoid so as to rotate when the solenoid is energized; and a roller rotatively mounted to the first end of the arm, wherein the control system energizes the rotary solenoid causing the roller to bear against the upper deck plate and pivot the upper deck plate from the closed position to the open position.

6. The apparatus of claim 1 wherein the sheet travels along a paper path from the input end to the output end of the deck, and further comprising stop means located along the paper path for halting travel of the sheet in the first direction and wherein the control means causes the feed means to feed the sheet in the second direction through the deck output end after the sheet has halted travel in the first direction.

7. The apparatus of claim 6 further comprising sensor means in operative communication with the control means located along the paper path for detecting the presence of the sheet and wherein the control means causes the pivoting means to rotate the upper deck plate from the open position to the closed position after the sensor means detects the sheet.

8. The apparatus of claim 7 wherein the pivoting means comprises:

a rotary solenoid fixably mounted to the lower deck plate;

an arm having a first end and a second end fixably mounted to the rotary solenoid so as to rotate when the solenoid is energized; and a roller rotatively mounted to the first end of the arm, wherein the control system energizes the rotary solenoid causing the roller to bear against the upper deck plate and pivot the upper deck plate from the closed position to the open position.

9. A method for receiving a sheet from a first direction and transporting the sheet in a second direction, the sheet traveling along a paper path through a deck having an input end and including a lower deck plate and an upper deck plate vertically spaced above the lower deck plate and pivotally mounted to rotate between a closed position where the lower deck plate and the upper deck plate are substantially parallel and an open position where the distance between input ends of the lower deck plate and the upper deck plate is greater than that of the closed position, the method comprising the step(s) of:

(a) pivoting the upper deck plate from the closed position to the open position;

(b) receiving the sheet from the first direction into the input end;

(c) pivoting the upper deck plate from the open position to the closed position; and (d) after step (c), feeding the sheet in the second direction.

10. The method of claim 9 further comprising the step(s) of:

(e) detecting the presence of the sheet along the paper path, and thereafter implementing step (c).

11. The method of claim 10 further comprising the step(s) of:

(f) halting travel of the sheet in the first direction before implementing step (d).

12. The method of claim 11 wherein step (a) occurs before step (b) and step (e) occurs before step (f).

13. The method of claim 12 wherein step (a) further comprises the step(s) of:

(e) energizing a rotary solenoid which is fixably mounted to the lower deck plate so that a roller rotatively mounted to a first end of an arm fixably mounted at a second end to the rotary solenoid bears against the upper deck plate and pivots the upper deck plate from the closed position to the open position.

14. The method of claim 9 further comprising the step(s) of:

(e) halting travel of the sheet in the first direction before implementing step (d).

15. The method of claim 14 further comprising the step(s) of:

(f) detecting the presence of the sheet along the paper path, and thereafter implementing step (c).

16. The method of claim 15 wherein step (a) occurs before step (b) and step (f) occurs before step (e).

17. The method of claim 16 wherein step (a) further comprises the step(s) of:

(e) energizing a rotary solenoid which is fixably mounted to the lower deck plate so that a roller rotatively mounted to a first end of an arm fixably mounted at a second end to the rotary solenoid bears against the upper deck plate and pivots the upper deck plate from the closed position to the open position.

18. The method of claim 9 wherein step (a) further comprises the step(s) of:

(e) energizing a rotary solenoid which is fixably mounted to the lower deck plate so that a roller rotatively mounted to a first end of an arm fixably mounted at a second end to the rotary solenoid bears against the upper deck plate and pivots the upper deck plate from the closed position to the open position.

* * * * *